US005572305A

United States Patent [19]

Hayashi et al.

[11] Patent Number: 5,572,305

[45] Date of Patent: Nov. 5, 1996

[54] IMAGE FORMING APPARATUS EMPLOYING MOVABLE SUPPORT FOR TRANSFER ROLLER

[75] Inventors: Shigeki Hayashi; Hiroyuki Ueda; Tadakazu Ogiri; Shinichi Kotera; Hiroki Morishita; Yasuhiko Moriuchi; Kohichi Yasuda; Naoyuki Ishida, all of Osaka, Japan

[73] Assignee: Mita Industrial Co., Ltd., Japan

[21] Appl. No.: 323,933

[22] Filed: Oct. 17, 1994

[30] Foreign Application Priority Data

Nov. 10, 1993 [JP] Japan ..... 5-281108
Nov. 16, 1993 [JP] Japan ..... 5-286347

[51] Int. Cl.[6] ..... G03G 15/14

[52] U.S. Cl. ..... 399/121; 399/313

[58] Field of Search ..... 355/271, 273, 355/274, 277, 200, 210

[56] References Cited

U.S. PATENT DOCUMENTS

| | | | |
|---|---|---|---|
| 4,185,907 | 1/1980 | Baier et al. | 355/200 |
| 4,431,301 | 2/1984 | Hashimoto et al. | 355/274 |
| 5,055,879 | 10/1991 | Bhagat | 355/219 |
| 5,126,796 | 6/1992 | Fujii et al. | 355/271 |
| 5,233,393 | 8/1993 | Minoru et al. | 355/271 |
| 5,438,391 | 8/1995 | Maekawa et al. | 355/200 |
| 5,502,554 | 3/1996 | Hayashi et al. | 355/271 |

FOREIGN PATENT DOCUMENTS

| | | | |
|---|---|---|---|
| 0537793 | 4/1993 | European Pat. Off. . | |
| 0603581 | 6/1994 | European Pat. Off. . | |
| 3109036 | 1/1982 | Germany . | |
| 3-004278 | 1/1991 | Japan | 355/277 |
| 4-019664 | 1/1992 | Japan | 355/277 |
| 4-355782 | 12/1992 | Japan | 355/277 |

OTHER PUBLICATIONS

Patent Abstracts of Japan, vol. 017, No. 658 (P–1654), Dec. 6, 1993 (Abstract of Japanese Patent Publication No. JP–A–05 216356, to Fujitsu Ltd., published Aug. 27, 1993).

Patent Abstracts of Japan, vol. 007, No. 134, (P–203), Jun. 11, 1983 (Abstract of Japanese Patent Publication No. JP–A–58 050563 to Ricoh KK, published Mar. 25, 1983.

Patent Abstracts of Japan, vol. 008, No. 060, (P–262), Mar. 22, 1984 (Abstract of Japanese Patent Publication No. JP–A–58 209764 to Olympus Kogaku Kogyo KK, published Dec. 6, 1983.

*Primary Examiner*—Arthur T. Grimley
*Assistant Examiner*—Shuk Yin Lee
*Attorney, Agent, or Firm*—Beveridge, DeGrandi, Weilacher & Young, L.L.P.

[57] ABSTRACT

In an image forming apparatus using a transfer unit of a roller transfer method, the contact between the transfer unit and a photoreceptor drum can easily be canceled. The transfer unit is brought into contact with the photoreceptor drum by supplying an upward pushing force to a supporting member of the transfer unit, and a lever engaging with the supporting member to push down the supporting member is provided to connect with a front cover of the apparatus body. The transfer roller, the pre-transfer roller for feeding a sheet to the photoreceptor drum and driving force transmitting gears provided therebetween are supported by the same member to fix their relative positions so that the driving force is constantly transmitted from the transfer roller to the pre-transfer roller.

6 Claims, 8 Drawing Sheets

IMAGE FORMING APPARATUS EMPLOYING MOVABLE SUPPORT FOR TRANSFER ROLLER

BACKGROUND OF THE INVENTION

1. Field of the Invention

The present invention relates to an image forming apparatus employing a roller transfer method such as an electrophotographic copying machine, a laser printer and a facsimile apparatus, and more particularly, to an image forming apparatus where the contact between a transfer unit and a photoreceptor drum can easily be canceled.

2. Description of the Prior Art

In an image forming apparatus employing an electrophotographic method, a latent image formed on the surface of a photoreceptor drum is developed by charged toner to form a toner image, and the toner image is transferred onto a sheet of paper to obtain a toner image on the sheet. As a method of transferring a toner image from the photoreceptor drum onto the sheet, a roller transfer method is known. According to the roller transfer method, a transfer roller is arranged opposite to the photoreceptor drum, and to transfer the toner image, a voltage of a polarity reverse to that of the toner image carried by the photoreceptor drum on its surface is applied to the transfer roller when the sheet passes between the photoreceptor drum and the transfer roller. The roller transfer method is divided into a contact type and a non-contact type according to whether or not the transfer roller is in contact with the surface of the photoreceptor drum.

As a method of holding the transfer roller so as to be out of contact with the photoreceptor drum in a transfer unit employing the non-contact type roller transfer method, for example, a gap maintaining roller as shown in FIG. 1 is used. To each end of a roller shaft 52 to which a transfer roller 51 is attached, a gap maintaining roller 53 having a diameter greater than that of the transfer roller 51 is attached, and the periphery of the gap maintaining roller 53 is rotatively in contact with the surface of the photoreceptor drum 54 so that a predetermined gap C is left between the transfer roller 51 and the photoreceptor drum 54.

Referring to FIG. 2, there is shown a schematic front view of a transfer unit using the gap maintaining roller 53. Below the photoreceptor drum 54, the transfer roller 51 is arranged so as to be out of contact with the drum surface by the above-described method. In the upstream side of the transfer roller 51, a pre-transfer guide 55 having a guide plate 55*a* for guiding a sheet P to the surface of the photoreceptor drum 54 is arranged. Above the guide plate 55*a*, a pre-transfer roller 56 for sending the sheet P to the photoreceptor drum 54 at a speed equal to the movement speed of the surface of the photoreceptor drum 54 is arranged so as to be substantially in contact with the upper surface of the guide plate 55*a*. The pre-transfer roller 56 is supported independently of the photoreceptor drum 54 and the transfer roller 51. In the upstream side of the pre-transfer guide 55, a pair of paper feeding rollers 57 are provided for guiding a sheet fed by a non-illustrated paper feeder to the upper surface of the guide plate 55*a*.

The photoreceptor drum 54 rotates by a driving force of a non-illustrated motor. It is necessary for the transfer roller 51 and the pre-transfer roller 56 to rotate at a predetermined speed in synchronism with the rotation of the photoreceptor drum 54. For this reason, a drum gear 58, a transfer roller gear 59 and a pre-transfer roller gear 60 are attached as shown in FIG. 3 to the rear side end portions of the photoreceptor drum shaft, the transfer roller shaft and the pre-transfer roller shaft, respectively. The drum gear 58 and the transfer roller gear 59 directly engage with each other, and the transfer roller gear 59 and the pre-transfer roller gear 60 engage with each other through two idle gears 61 and 62. With this arrangement, the rotation of the photoreceptor drum 54 is transmitted to the transfer roller shaft and to the pre-transfer roller shaft, so that the photoreceptor drum 54, the transfer roller 51 and the pre-transfer roller 56 rotate in the directions of arrows a, b and c, respectively, as shown in FIG. 2.

In an image forming apparatus such as a copying machine, it is necessary to detach the photoreceptor drum and a unit such as a developer unit arranged around the photoreceptor drum at a maintenance work. In a conventional apparatus, these units are detached and attached from the front side of the apparatus by opening the front cover. Specifically, to detach and attach the photoreceptor drum, the photoreceptor drum is moved forward and backward as shown by the arrow d in FIG. 1. In an apparatus having a transfer unit of the non-contact type roller transfer method using the gap maintaining roller, the drum surface may be damaged when the photoreceptor drum is detached or attached since the gap maintaining roller is always in contact with the surface of the photoreceptor drum.

Moreover, when a paper jam occurs during copying, the sheet jamming inside the apparatus should be removed. The removal of the jamming sheet is also made from the front side of the apparatus by opening the front cover. However, the sheet cannot easily be removed because of the small gap between the transfer roller and the photoreceptor drum surface and the presence of the gap maintaining roller which is in contact with the drum surface.

These disadvantages occur not only in a transfer unit of the non-contact type roller transfer method but also in a transfer unit of the contact-type roller transfer method. In particular, when paper jam occurs during copying, it is very difficult to remove the sheet which is nipped between the transfer roller and the photoreceptor drum.

To facilitate the above-mentioned works, a machine of a clamshell structure is used which has an openable and closable upper portion. In a machine of the clamshell structure, since the upper portion of the machine is separated from the lower portion at the sheet passage, the removal of a sheet jamming at the sheet passage and the attachment and detachment of the photoreceptor drum are facilitated, and the drum surface is less likely damaged.

However, the opening and closing of the clamshell structure is onerous to users, and it diminishes the efficiency to open the clamshell structure every time a paper jam occurs. Therefore, it is desirable to provide a transfer unit where the gap maintaining roller of the non-contact type roller transfer method or the transfer roller of the contact-type roller transfer can be separated from the photoreceptor drum surface when necessary in order that jammed sheets can be removed without any need to open the clamshell structure.

After a jammed sheet is removed in such a manner, the transfer roller gear, the idle gears and the pre-transfer roller gear should appropriately be engaged with one another when the transfer unit is arranged again so that the gap maintaining roller or the transfer roller is brought in contact with the photoreceptor drum. These gears are of small diameter since they are arranged in a small space, and unless their relative positions are appropriately set, the teeth of the gears do not correctly engage. In particular, at the idle gears of small diameter, a slight variation in position would break the correct engagement of the teeth. Consequently, the pre-transfer roller does not rotate at the predetermined speed. If the rotation speed of the pre-transfer roller changes, a difference is caused between the surface speed of the photoreceptor drum and the conveying speed of the sheet, so that the toner on the drum surface is rubbed by the sheet to damage the toner image.

SUMMARY OF THE INVENTION

An object of the present invention is to cancel and restore a contact between a photoreceptor drum and a transfer unit by opening and closing a front cover of an apparatus body in an image forming apparatus using a transfer unit of a roller transfer method.

Another object of the present invention is to cancel and restore the contact between the photoreceptor drum and the transfer unit without causing variation in positions of the transfer roller and a pre-transfer roller for feeding a sheet to the photoreceptor drum relative to the photoreceptor drum and without causing variation in transmission of a driving force from the transfer roller to the pre-transfer roller.

To achieve the above-mentioned objects, according to the present invention, the transfer roller is arranged below the photoreceptor drum, and both ends of a transfer roller shaft are rotatably supported by a transfer roller supporting member. The transfer roller supporting member is elastically pushed upward, and a lever is provided which moves forward and backward as the front cover of the apparatus is opened and closed. The transfer roller supporting member and the lever are provided with engagement portions which engage with each other to push down the transfer roller supporting member against the upward pushing force when the lever is moved forward. In addition to this arrangement, a gap maintaining roller having a diameter greater than that of the transfer roller may be attached to each end of the transfer roller shaft.

Further, the pre-transfer roller is also supported by the transfer roller supporting member, and a gear for transmitting a driving force from the transfer roller to the pre-transfer roller is arranged at the transfer roller supporting member.

In this arrangement, under a condition where the front cover is closed, an upward pushing force is supplied to the transfer roller supporting member, so that the transfer roller or the gap maintaining roller is in contact with the photoreceptor drum. When the front cover is opened, the lever moves forward in response to the opening of the front cover, so that the engagement portion of the lever engages with the engagement portion of the transfer roller supporting member to lower the transfer roller supporting member. Thereby, the contact between the transfer roller or the pre-transfer roller and the photoreceptor drum is canceled. When the front cover is closed, the lever moves backward in response to the closing of the front door, so that the lever is disengaged from the transfer roller supporting member. Since the transfer roller supporting member is pushed upward by the elastic pushing force, the transfer roller or the pre-transfer roller is again in contact with the photoreceptor drum.

The pre-transfer roller, which is supported by the transfer roller supporting member, descends and ascends together with the transfer roller during the above-mentioned operation, and when the contact between the transfer roller or the gap maintaining roller and the photoreceptor drum is restored, the pre-transfer roller is located at the same position where it was located before the contact was canceled. Consequently, no variation is caused in positions of the transfer roller and the pre-transfer roller relative to the photoreceptor drum. In addition, since the gear for transmitting the driving force is also arranged at the transfer roller supporting member, the transmission of the driving force from the transfer roller to the pre-transfer roller is maintained constant.

BRIEF DESCRIPTION OF THE DRAWINGS

These and other objects and features of this invention will become clear from the following description, taken in conjunction with the preferred embodiments with reference to the accompanied drawings in which.

DESCRIPTION OF THE PREFERRED EMBODIMENTS

Figure 1:
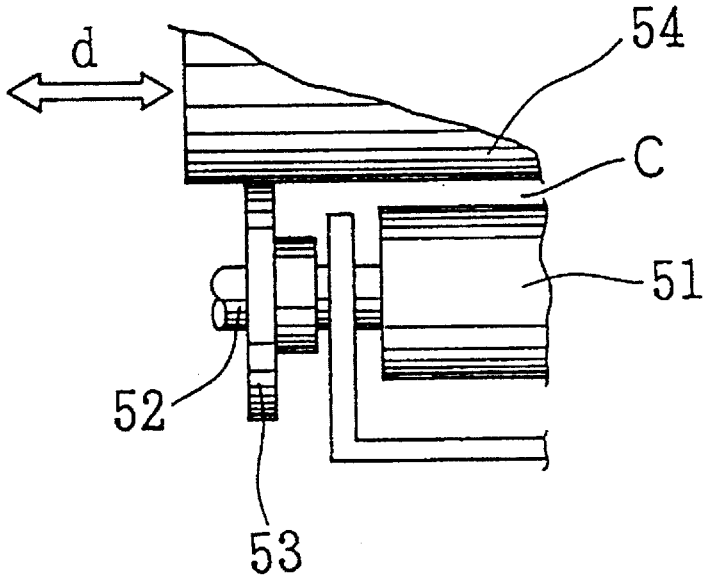
Fig. 1 Prior Art
FIG. 1 is a side view of the arrangement around an end portion of a transfer roller of a conventional transfer unit employing the non-contact type roller transfer method.
Figure 2:
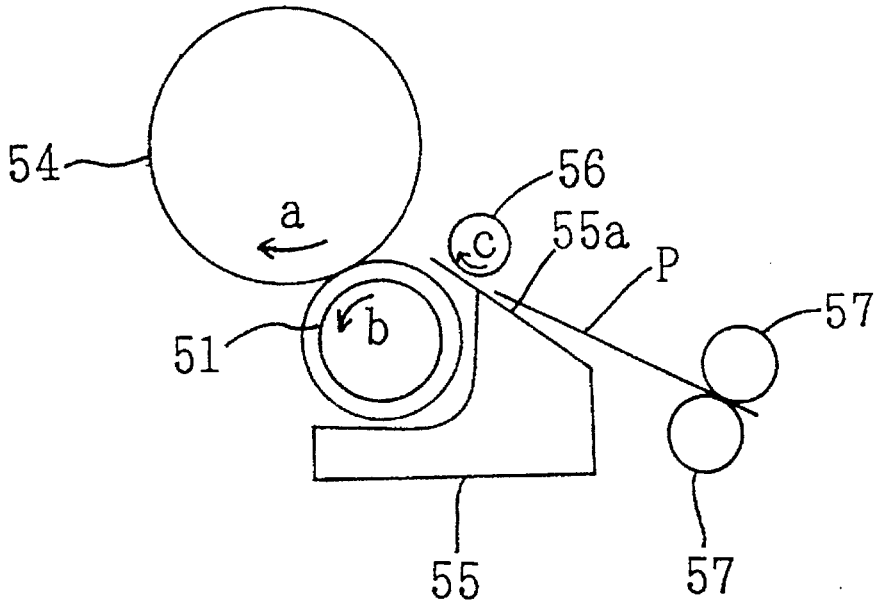
Fig. 2 Prior Art
FIG. 2 is a schematic front view of the arrangement of a conventional transfer unit employing the non-contact type roller transfer method.
Figure 3:
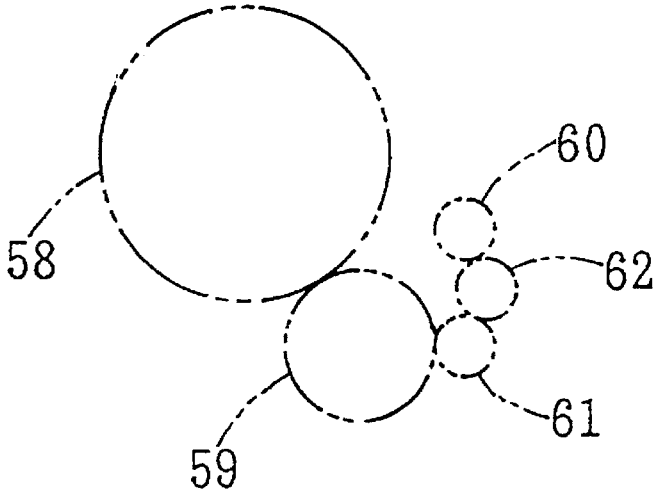
Fig. 3 Prior Art
FIG. 3 shows the arrangement of driving force transmitting gears of a conventional transfer unit.
Figure 4:
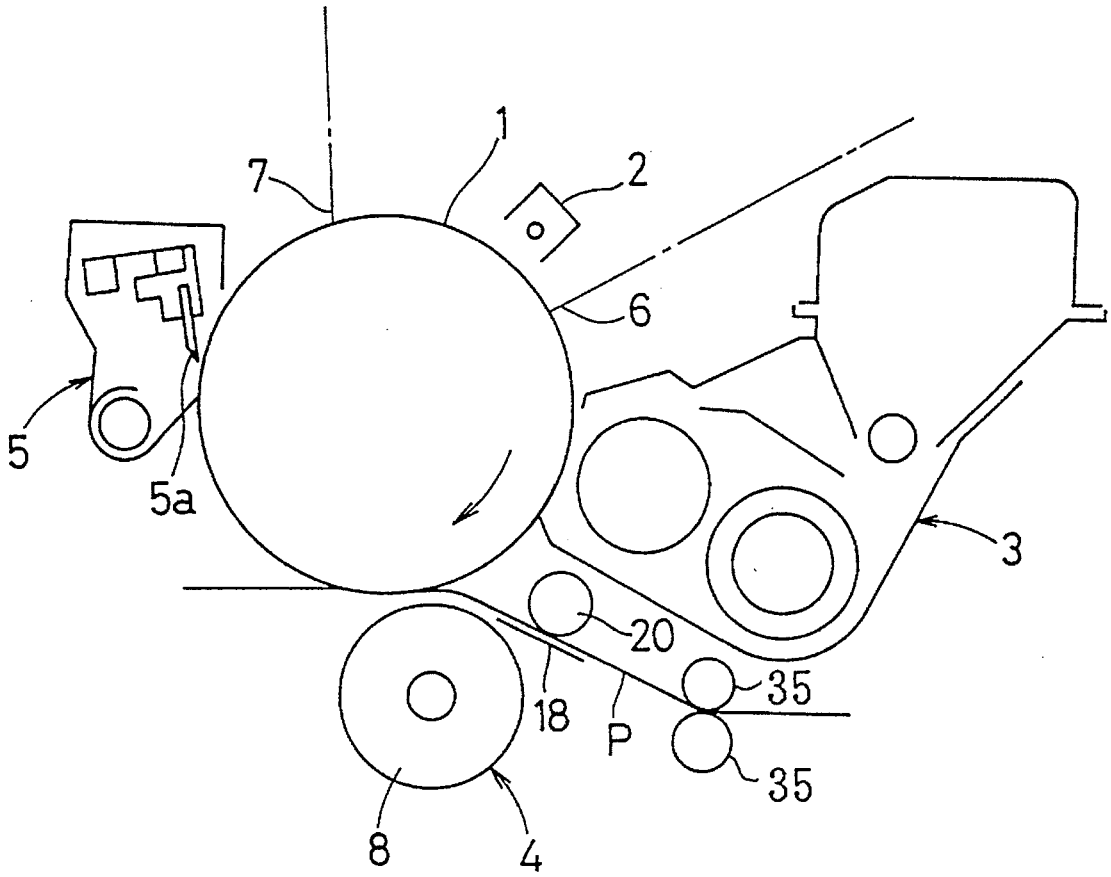
FIG. 4 is a front view of the arrangement of a copying machine according to an embodiment of the present invention.
Figure 5:
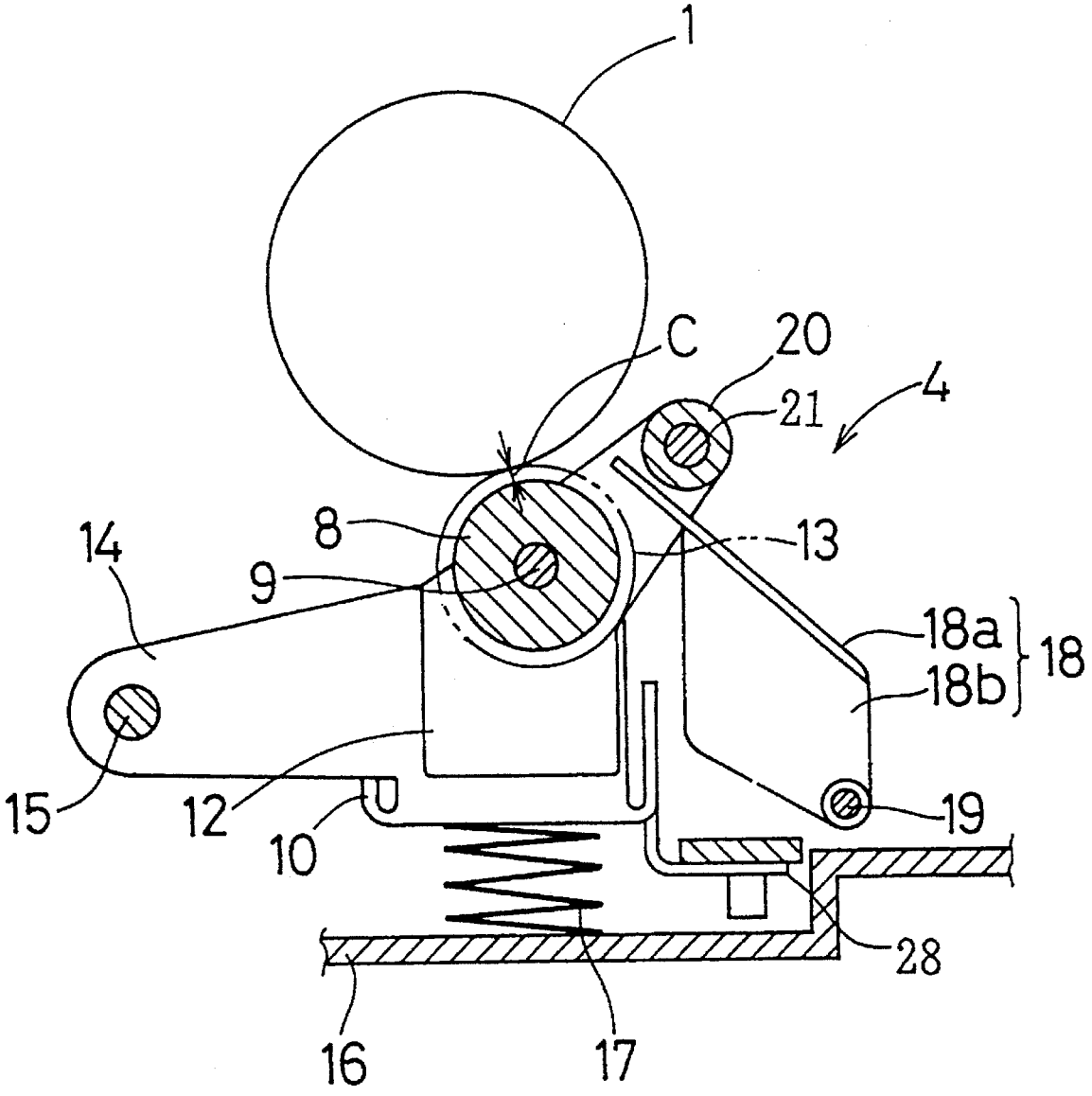
FIG. 5 is a front view of a transfer unit of the embodiment of the present invention.

An electrophotographic copying machine embodying the present invention will be described with reference to the drawings. Referring to FIG. 4, there is shown a schematic front view of a relevant portion of the copying machine. Along the periphery of a photoreceptor drum 1, the following are provided in this order in the rotation direction of the drum 1: a main charger 2 including a corona discharger; a developer unit 3; a transfer unit 4; and a cleaning unit 5.

Between the main charger 2 and the developer unit 3, an exposure portion 6 is arranged, and between the cleaning unit 5 and the main charger 2, a charge removing portion 7 is arranged. On a sheet passage between a non-illustrated paper feeder and the transfer unit 4, a pair of paper feeding rollers 35 are arranged for feeding the sheet at a speed equal to the movement speed of the drum surface at a predetermined timing. Although not shown, the copying machine of this embodiment is of a clamshell structure where the upper portion which is openable and closable through a hinge is separated from the lower portion at the sheet passage passing between the drum 1 and the transfer unit 4.

In a copying machine provided with this structure, the surface of the photoreceptor drum 1 is charged by corona discharging of the main charger 2. On the charged drum surface, an electrostatic latent image of an original image read out by an optical system (not shown) provided in an upper part of the machine body is formed at the exposure portion 6. Then, by the developer unit 3, charged toner is attached to the electrostatic latent image to form a toner image of the original image. While the toner image is being formed, the sheet P is fed to the gap between the drum 1 and the transfer unit 4 at a predetermined timing, and the transfer unit operates in a subsequently-described manner to transfer the toner image on the drum surface onto the sheet P.

After the transfer, toner remaining on the drum surface is removed by a cleaning blade 5*a* provided in the cleaning unit 5, and the charge on the drum surface is removed at the charge removing portion 7, so that the drum surface is ready for the next charging. The sheet P on which the toner image has been transferred is heated and pressurized by a fixing unit (not shown) arranged on the downstream side of the transfer unit 4 in the machine body to thereby fix the toner image. Finally, the sheet P is discharged from the machine body.

Referring to FIGS. 5 to 8, there is shown the specific arrangement of the transfer unit 4. Below the photoreceptor drum 1, a transfer roller 8 is arranged to be parallel to the photoreceptor drum 1. The transfer roller 8 includes an internal tube made of, for example, a metallic material having an excellent conductivity such as copper, aluminum and iron or of a conductive resin material containing carbon, and an external tube having an elastic tube such as a sponge tube and nesting the internal tube therein. The transfer roller 8 has a length to cover the image forming area on the drum surface.

A roller shaft 9 to which the transfer roller 8 is attached is rotatably supported at its both ends by bearings 12 fixed by screws 11 to front and rear walls 10*a* of a housing 10 having a U-shaped cross section. To each end of the roller shaft 9 protruding outward from the bearings 12, a gap maintaining roller 13 of a diameter slightly greater than that of the transfer roller 8 is attached. The front and rear gap maintaining rollers 13 have the same diameter and are attached to the transfer roller shaft 9 not to be fixed but to be rotatable independently of the rotation of the transfer roller 9.

At both ends of the housing 10, brackets 14 extending from the front and rear walls 10*a* are provided, and a shaft 15 is arranged through the brackets 14. Both ends of the shaft 15 are supported by side plates (not shown) provided at the front and rear sides of the machine body, thereby supporting the housing 10 to be swingable upward and downward about the shaft 15. Between the housing 10 and a base 16 of the machine body, a spring 17 of a compression coil spring is provided to push the housing 10 upward.

In this arrangement, since the housing 10 is swung upward about the shaft 15 by being pushed by the spring 17, the periphery of the gap maintaining roller 13 supported by the roller shaft 9 through the bearing 12 abuts the surface of the photoreceptor drum 1. Thereby, a predetermined gap C is left between the transfer roller 8 and the drum surface. In this embodiment, the gap C is approximately 0.5 mm.

In the vicinity of the upstream side of the transfer roller 8, a pre-transfer guide 18 is arranged for guiding the sheet P to the drum surface. The pre-transfer guide 18 has a guide plate 18*a* which is long in the direction from the front to the rear of the machine body. The guide plate 18*a* is arranged to be parallel to the photoreceptor drum 1 and to ascend from the upstream side to the downstream side on the sheet passage. At each of the front and rear ends of the guide plate 18*a*, a bracket 18*b* is provided. The brackets 18*b* are supported to be swingable upward and downward by a shaft 19 provided to connect the front and rear side plates of the machine body, and are pushed upward by springs (not shown) provided between the brackets 18*b* and the base 16.

Above the pre-transfer guide 18, a pre-transfer roller 20 for sending the sheet P to the drum surface at a speed equal to the movement speed of the drum surface is arranged so that a slight gap is left between the upper surface of the guide plate 18*a* and the pre-transfer roller 20. A roller shaft 21 of the pre-transfer roller 20 is rotatably supported at each end by a pre-transfer roller bearing portion 12*b* arranged at a position closer to the front end than the transfer roller bearing portion 12*a* of the bearing 12.

Figure 8:
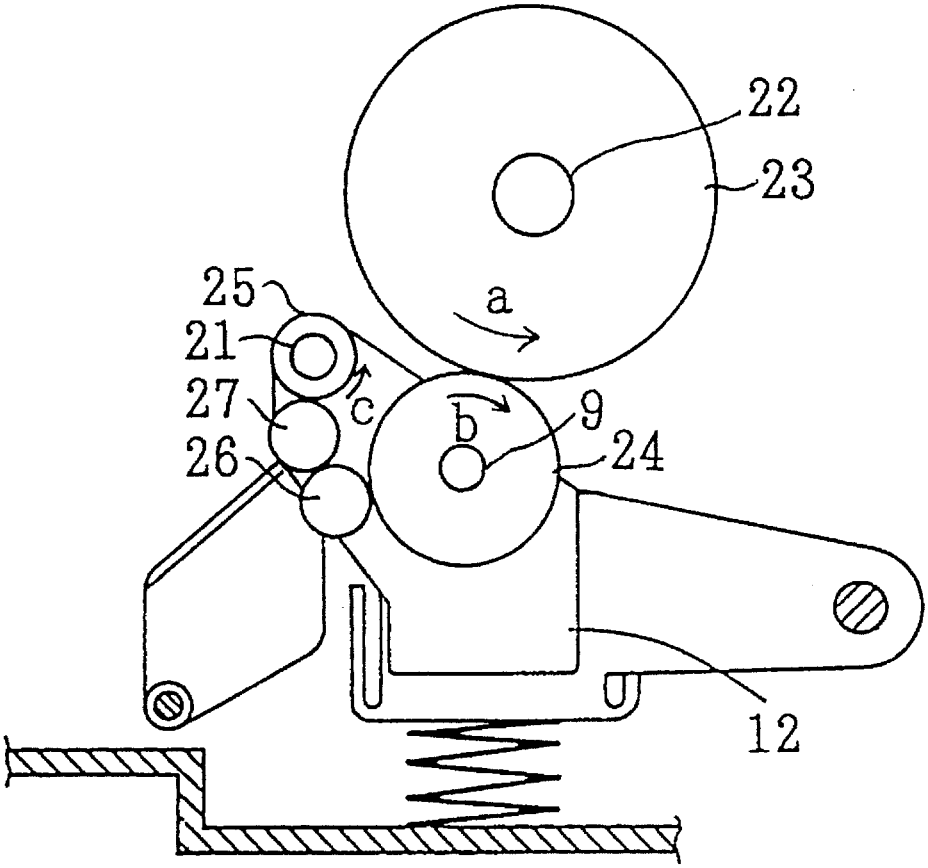
FIG. 8 is a rear view of the transfer unit of the embodiment of the present invention.

Referring to FIG. 8, there is schematically shown the transfer unit 4 viewed from the rear side of the machine. At the end of a drum shaft 22 of the photoreceptor drum 1, a drum gear 23 is attached. A motor (not shown) is provided inside the machine, and the driving force of the motor is transmitted to the drum gear 23 through a driving force transmitting system including gears and clutches to rotate the photoreceptor drum 1 in the direction of arrow a. To the end of the transfer roller shaft 9, a transfer roller gear 24 is attached. The transfer roller gear 24 engages with the drum gear 23. At the end of the pre-transfer roller shaft 21, a pre-transfer roller gear 25 is attached. At the bearing 12 on the rear side, two idle gears 26 and 27 of small diameter are rotatably arranged. The first idle gear 26 engages with the transfer roller gear 24 and the second idle gear 27, and the second idle gear 27 engages with the pre-transfer roller gear 25.

The driving force from the motor is transmitted to the transfer roller shaft 9 through the drum gear 23 and the transfer roller gear 24, and is further transmitted to the pre-transfer roller shaft 21 through the first and second idle gears 26 and 27 and the pre-transfer roller gear 25. Thereby, when the photoreceptor drum 1 rotates in the direction of arrow a, the transfer roller 8 and the pre-transfer roller 20 rotate in the directions of arrow b and arrow c, respectively. Thus, all the rotating members rotate in directions corresponding to the sheet conveying direction.

The numbers of teeth of the drum gear 23, the transfer roller gear 24 and the pre-transfer roller gear 25 are set to be proportional to the diameters of the photoreceptor drum 1, the transfer roller 8 and the pre-transfer roller 20, respectively. The movement speeds of the drum surface, the transfer roller surface and the pre-transfer roller surface are the same. The gap maintaining roller 13 rotatively in contact with the drum surface is arranged to rotate independently of the rotation of the transfer roller shaft 9. The gap maintaining roller 13 whose periphery moves at a speed equal to the speed of the drum surface rotates at a rotation speed slightly lower than that of the transfer roller shaft 9.

Since the transfer roller shaft 9, the pre-transfer roller shaft 21 and the first and second idle gears 26 and 27 are supported by the same member, i.e. by the bearing 12, their relative positions are fixed, and the engagement condition of the gear train from the transfer roller gear 24 to the pre-transfer roller gear 25 never varies.

In the transfer unit 4 of this embodiment having the above-described arrangement, the sheet P fed by the paper feeder at a predetermined timing is guided to the upper surface of the guide plate 18*a* of the pre-transfer guide 18, and abuts the surface of the photoreceptor drum 1. At this time, the movement speed of the sheet P is the same as that of the drum surface because of the working of the paper feeding rollers 35. The front end of the sheet P is directed toward the gap C between the transfer roller 8 and the drum 1 while abutting the drum surface. The sheet P bulges upward while being supported at its under surface by the front end of the guide plate 18*a*. For this reason, the upper surface of the sheet P comes in contact with the pre-transfer roller 20 and receives a conveying force also from the pre-transfer roller 20. By the conveying force, the sheet P moves at a speed equal to that of the drum surface after it is released from the paper feeding rollers 35. Further, since the sheet P is supported at its undersurface by the front end of the guide plate 18*a* and is pressed at its upper surface by the pre-transfer roller 20, the upper surface of the sheet P is in close contact with the surface of the photoreceptor drum 1 at the gap C because of the resiliency of the sheet P.

When the sheet P passes through the gap C between the transfer roller 8 and the drum 1, a voltage of a polarity reverse to that of the toner on the drum surface is applied to the transfer roller 8. Thereby, the toner image carried by the photoreceptor drum 1 on its surface is transferred onto the upper surface of the sheet P. After the transfer, the sheet P is separated from the drum surface and sent to the fixing unit as described previously.

While the pre-transfer roller 20 and the guide plate 18*a* of the pre-transfer guide 18 are out of contact with each other in this embodiment, the pre-transfer roller 20 may be arranged to be substantially in contact with the upper surface of the guide plate 18*a*.

Figure 6:
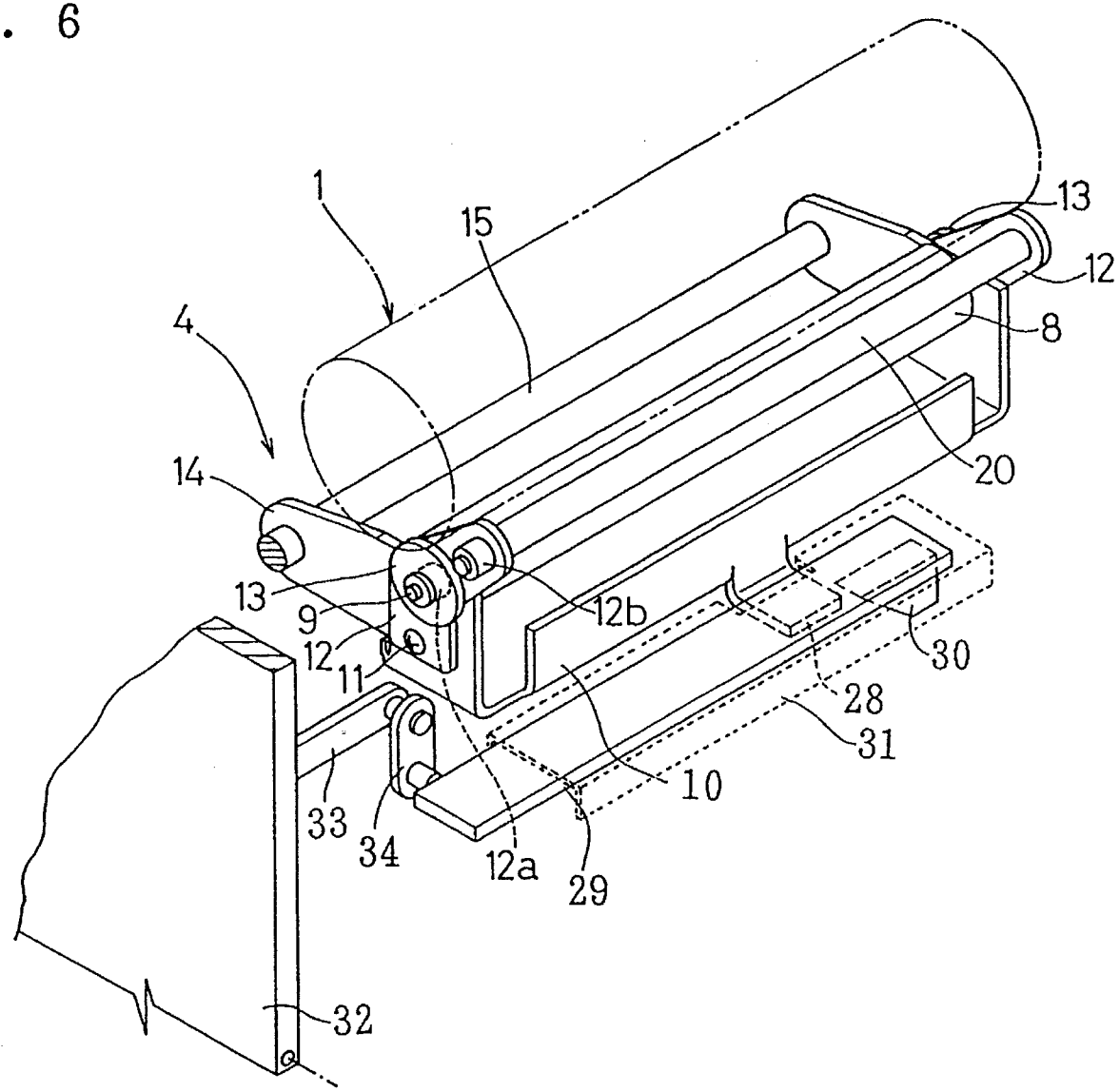
FIG. 6 is a projected perspective view of the transfer unit of the embodiment of the present invention.
Figure 7:
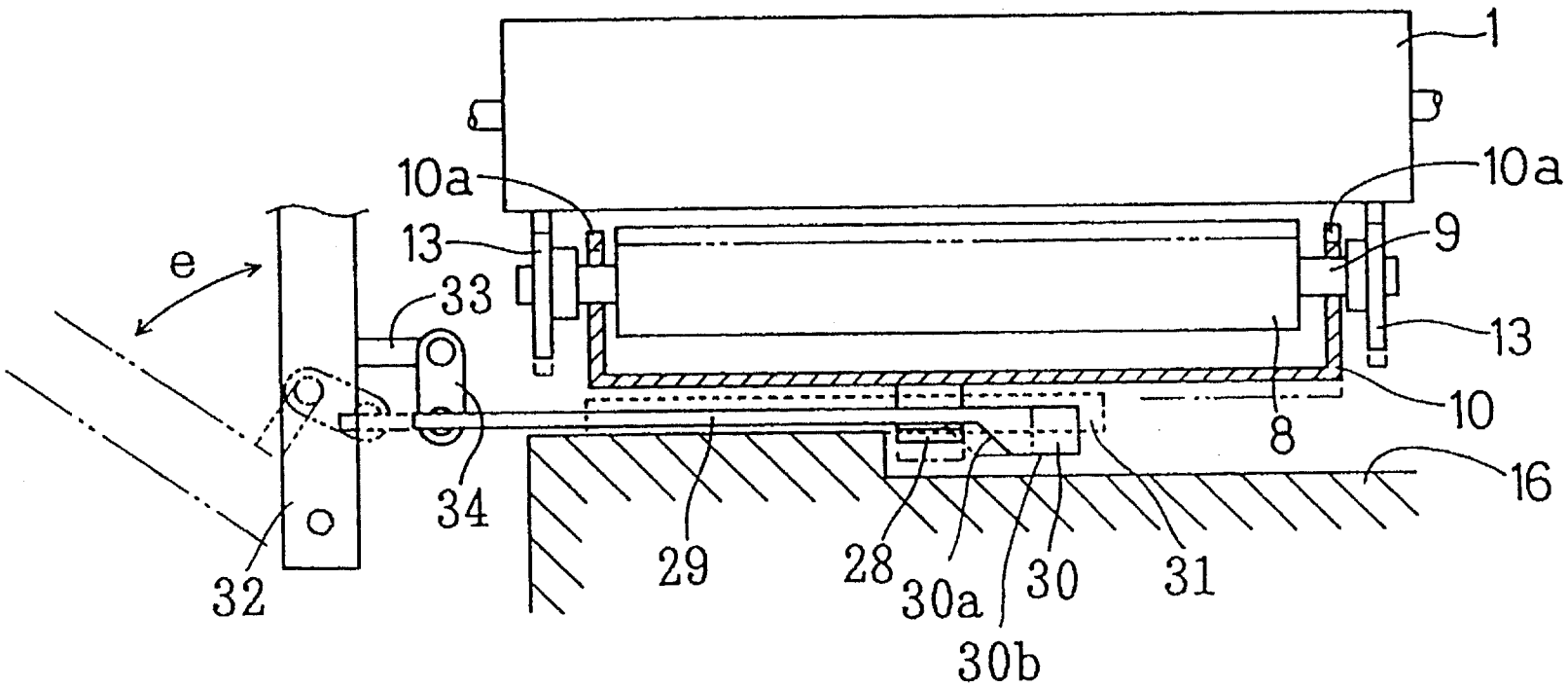
FIG. 7 is a side view of the transfer unit of the embodiment of the present invention.

Subsequently, a mechanism will be described for separating the gap maintaining roller 13 from the photoreceptor drum 1. As shown in FIGS. 6 and 7, in the housing 10 of the transfer unit 4, an L-shaped cam follower 28 is formed at the center in the front and rear direction. Above the cam follower 28, a releasing lever 29 which is long along the front and rear direction is arranged to be movable backward and forward with its undersurface being in contact with the upper surface of the cam follower 28. In the vicinity of the rear end of the undersurface of the releasing lever 29, a cam 30 is formed which has an inclination 30*a* descending toward the rear side and a succeeding horizontal portion 30*b*. The cam 30 abuts the upper surface of the cam follower 28 when the releasing lever 29 is moved forward. A releasing lever guide 31 formed to cover the releasing lever 29 is fixed to the base 16 of the machine body.

At the front surface of the machine body, a front cover 32 is provided. The front cover 32 is pivotally openable and closable about its lower end in the direction of arrow e in FIG. 7. At the internal surface of the front cover 32, a connecting rod 33 is provided to protrude substantially horizontally. To the end of the connecting rod 33, one end of a linking member 34 is connected. The other end of the linking member 34 is connected to the base end of the releasing lever 29 so that the releasing lever 29 moves forward and backward as the front cover 32 is opened and closed.

Figure 9A:
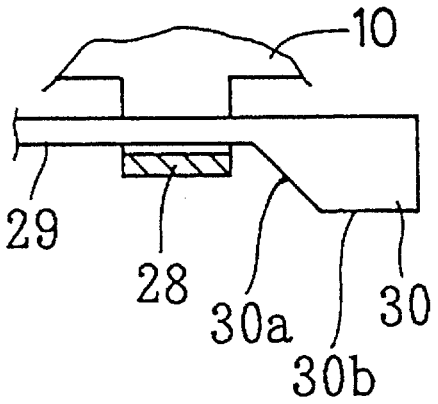
FIGS. 9A and 9B show an operation of a contact cancellation mechanism of the transfer unit of the embodiment of the present invention.

In this arrangement, under a condition where the front cover 32 is closed, the housing 10 is pushed upward by the spring 17 and the gap maintaining roller 13 is in contact with the photoreceptor drum 1. At this time, the cam 30 of the releasing lever 29 and the cam follower 28 of the housing 10 are located at positions in FIGS. 9A where they do not engage with each other.

Figure 9B:
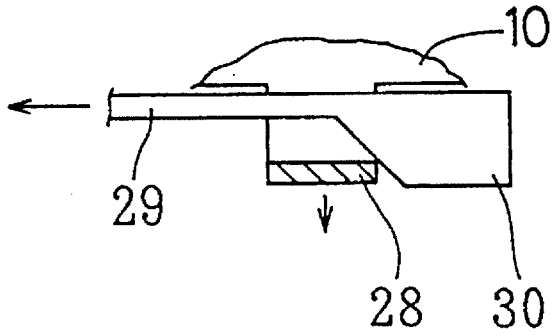

When the front cover 32 is opened, the releasing lever 29 moves toward the front side of the machine, and the inclination 30*a* of the cam 30 abuts the cam follower 28. Since the upward movement of the releasing lever 29 is restricted by the contact of the upper surface of the lever 29 with the internal surface of the releasing lever guide 31, the cam 30 pushes down the cam follower 28 as shown in FIG. 9B. Thereby, the housing 10 is pushed down against the pushing force of the spring 17, so that the gap maintaining roller 13 is separated from the surface of the photoreceptor drum 1. When the horizontal portion 30*b* of the cam 30 is located above the cam follower 28, the separation of the gap maintaining roller 13 from the photoreceptor drum 1 is maintained.

When the front cover 32 is closed, the releasing lever 29 moves backward to disengage the cam 30 and the cam follower 28. The housing 10 is pushed up by the spring 17, so that the gap maintaining roller 13 abuts the drum surface again.

As described above, according to the present invention, the contact between the gap maintaining roller and the photoreceptor drum can easily be canceled and restored only by opening and closing the front cover. Since the cancellation of the contact between the gap maintaining roller and the photoreceptor drum is maintained all while the front cover is opened, the jamming sheet can be removed during this time.

Moreover, since the pre-transfer roller and the transfer roller are supported by the same bearing, when the gap maintaining roller again abuts the photoreceptor drum by closing the front cover, the pre-transfer roller is returned to the position where it was located before the contact was canceled. Consequently, the angle of the sheet fed to the photoreceptor drum by the pre-transfer roller to the drum surface is maintained constant. Further, since the system for transmitting the driving force from the transfer roller to the pre-transfer roller is supported by the same member, the cancellation and restoration of the contact between the gap maintaining roller and the photoreceptor drum never affect the rotation speed of the pre-transfer roller. Consequently, the sheet is always fed at a speed equal to that of the surface of the photoreceptor drum. As a result, images are excellently transferred without any image shift.

The gap maintaining roller-photoreceptor drum contact cancellation mechanism of the present invention is advantageous not only for use in an image forming apparatus employing the non-contact type roller transfer method but also in an image forming apparatus employing the contact-type roller transfer method. Further, the mechanism of the present invention may be employed not only in an image forming apparatus of a clamshell structure but also in an image forming apparatus of a structure where the upper portion is not opened and closed. In this case, since the photoreceptor drum can be detached and attached without the surface of the photoreceptor drum being damaged, the maintenance work is facilitated.

Obviously, many modifications and variations of the present invention are possible in light of the above teachings. It is therefore to be understood that within the scope of the appended claims, the invention may be practiced other than as specifically described.

What is claimed is:

1. An image forming apparatus in which a transfer roller is arranged below a photoreceptor drum, said image forming apparatus comprising:

a supporting member arranged to be movable upward and downward for supporting both ends of a roller shaft of the transfer roller;

a pushing member which elastically pushes the supporting member upward;

a front cover provided at a front surface of a body of the apparatus so as to open frontward; and a pushing down member arranged to connect with the front cover, said pushing down member moving forward and backward as the front cover is opened and closed, and when moving forward, engaging with the supporting member to push down the supporting member against a pushing force of the pushing member.

2. An image forming apparatus according to claim 1, wherein when the front cover is closed, the transfer roller is brought into contact with the photoreceptor drum by the pushing force of the pushing member, and when the front cover is opened, the transfer roller is separated from the photoreceptor drum.

3. An image forming apparatus according to claim 1, wherein a gap maintaining roller having a diameter greater than a diameter of the transfer roller is attached to the roller shaft of the transfer roller, and wherein when the front cover is closed, the gap maintaining roller is brought into contact with the photoreceptor drum by the pushing force of the pushing member so that a gap is left between the transfer roller and the photoreceptor drum, and when the front cover is opened, the gap maintaining roller is separated from the photoreceptor drum.

4. An image forming apparatus according to claim 1, wherein said supporting member is provided with a cam follower, and wherein said pushing down member is provided with a cam including an inclination descending from a front toward a rear and a horizontal surface succeeding the inclination, and wherein said cam and said cam follower engage with each other to push down the supporting member.

5. An image forming apparatus in which a transfer roller is arranged below a photoreceptor drum and a pre-transfer roller rotating as the transfer roller rotates is arranged at an upstream side of the transfer roller, said pretransfer roller being provided for feeding a sheet to a position between the transfer roller and the photoreceptor drum at a predetermined speed, said image forming apparatus comprising:

a supporting member arranged to be movable upward and downward, said supporting member having side walls for supporting both ends of a roller shaft of the transfer roller and both ends of a roller shaft of the pre-transfer roller;

a pushing member which elastically pushes the supporting member upward;

a front cover provided at a front surface of a body of the apparatus so as to open frontward; and a pushing down member arranged to connect with the front cover, said pushing down member moving forward and backward as the front cover is opened and closed, and when moving forward, engaging with the supporting member to push down the supporting member against a pushing force of the pushing member.

6. An image forming apparatus according to claim 5, wherein a transfer roller gear is arranged at an end of the roller shaft of the transfer roller and a pre-transfer roller gear is arranged at an end of the roller shaft of the pre-transfer roller, and the end of the roller shaft of the transfer roller and the end of the roller shaft of the pre-transfer roller are supported by a same side wall, and wherein a transmitting gear for transmitting a rotation of the transfer roller gear to the pre-transfer roller gear is arranged at said side wall.

* * * * *